US006663825B2

(12) United States Patent
Grant, Jr. et al.

(10) Patent No.: US 6,663,825 B2
(45) Date of Patent: Dec. 16, 2003

(54) METHOD AND APPARATUS FOR INSTALLING OR REPLACING A FURNACE TAP HOLE INSERT

(75) Inventors: Louis A. Grant, Jr., Pittsburgh, PA (US); Albert J. Kristoff, Allison Park, PA (US)

(73) Assignee: Louis A. Grant, Inc., Export, PA (US)

( * ) Notice: Subject to any disclaimer, the term of this patent is extended or adjusted under 35 U.S.C. 154(b) by 0 days.

(21) Appl. No.: 10/262,677

(22) Filed: Sep. 30, 2002

(65) Prior Publication Data

US 2003/0123942 A1 Jul. 3, 2003

Related U.S. Application Data

(63) Continuation of application No. 09/619,730, filed on Jul. 19, 2000, now abandoned.
(60) Provisional application No. 60/144,517, filed on Jul. 19, 1999.

(51) Int. Cl.[7] ..... C21B 9/10
(52) U.S. Cl. ..... 266/135; 266/271; 266/272; 266/DIG. 1
(58) Field of Search ..... 226/135, 271, 226/272, DIG. 1; 408/103

(56) References Cited

U.S. PATENT DOCUMENTS

| | | | |
|---|---|---|---|
| 1,117,917 | A | 11/1914 | Schoenky |
| RE15,928 | E | 10/1924 | Judy |
| 3,218,893 | A | 11/1965 | Madison et al. |
| 3,833,334 | A | 9/1974 | Riley |
| 4,097,033 | A | 6/1978 | Mailliet |
| 4,180,564 | A | 12/1979 | Godfrey et al. |
| 4,195,825 | A | 4/1980 | Ulveling et al. |
| 4,201,502 | A | 5/1980 | Skendrovic |
| 4,378,054 | A | 3/1983 | Bourcier et al. |
| 4,427,184 | A | 1/1984 | Steinwider et al. |
| 4,544,143 | A | 10/1985 | Cooper et al. |
| 4,669,707 | A | 6/1987 | Kenning |
| 4,758,121 | A | 7/1988 | Kwech |
| 4,773,815 | A | 9/1988 | Lemelson |
| 4,819,526 | A | 4/1989 | Geise |
| 4,842,452 | A | 6/1989 | Strait |
| 4,915,549 | A | 4/1990 | Riddell |
| 5,133,534 | A | 7/1992 | Gortan et al. |
| 5,281,079 | A | 1/1994 | Lemelson |
| 5,423,654 | A | 6/1995 | Rohrbaugh |
| 5,735,647 | A | 4/1998 | Woodings et al. |
| 5,971,677 | A | 10/1999 | Lan |
| 6,086,816 | A | 7/2000 | Lee et al. |

FOREIGN PATENT DOCUMENTS

| | | |
|---|---|---|
| FR | 2685653 | 4/1998 |
| GB | 2 210 151 A | 6/1989 |
| JP | 358224104 | 12/1983 |

OTHER PUBLICATIONS

US 6,551,547, 4/2003, Grant, Jr. et al. (withdrawn).*

* cited by examiner

*Primary Examiner*—Scott Kastler
(74) *Attorney, Agent, or Firm*—Webb Ziesenheim Logsdon Orkin & Hanson, P.C.

(57) ABSTRACT

An apparatus for replacing a tap hole insert in a furnace includes a drill detachably mounted to a drive shaft in a boom arm of a utility machine with the drill adapted to remove the existing tap hole inserts to be replaced from outside of the furnace interior, and a tap hole insert tool detachably mounted to the boom arm of the utility machine with the tap hole insert tool adapted to hold and insert tap hole inserts into the furnace tap hole from outside the furnace interior. The drill is provided with a locking pattern having alternating inserts.

22 Claims, 13 Drawing Sheets

METHOD AND APPARATUS FOR INSTALLING OR REPLACING A FURNACE TAP HOLE INSERT

This application is a continuation of now abandoned U.S. patent application Ser. No. 09/619,730 entitled, "Method and Apparatus for Installing or Replacing a Furnace Tap Hole Insert", filed on Jul. 19, 2000 now abandoned, which claimed the benefit of U.S. Provisional Patent Application Serial No. 60/144,517, entitled, "Method and Apparatus for Installing and Replacing a Furnace Tap Hole Insert", filed on Jul. 19, 1999, both of which are incorporated by reference in their entirety.

BACKGROUND OF THE INVENTION

1. Field of the Invention

The invention relates generally to furnaces, particularly electric arc furnaces and, more particularly, to a method and apparatus for installing or replacing a furnace tap hole insert.

2. Description of the Currently Available Technology

In conventional furnaces, such as EBT or electric bottom tap arc furnaces, molten metal from the furnace is removed through a tap hole formed in a well block at the bottom of the furnace. The well block is made of refractory material and has a well block channel formed therein. A plurality of stacked, annularly-shaped tap hole insert pieces are placed in the well block channel to form a tap hole insert, with the central openings of the insert pieces aligned to form a tap hole passage in the bottom of the furnace. The tap hole passage defines the flow path of molten metal out of the furnace. The insert pieces are typically formed of refractory material. The stacked tap hole insert pieces are held in position in the well block channel by bonding material, such as conventional "dry vibe" material, which is poured into the gap formed between the sides of the insert pieces and the side of the well block channel. The insert pieces are also supported by a retaining piece attached to the bottom of the furnace to help prevent the insert pieces from dropping out of the bottom of the well block channel during use. For example, the retaining piece may have slots or holes, which are configured to engage lugs on the bottom of the furnace.

Molten metal from the furnace flows through the tap hole passage formed by the aligned tap hole insert pieces and out of the bottom of the furnace. With time, the insert material begins to burn away due to the passage of the molten metal, which increases the inside diameter of the tap hole passage. When the annular width of the insert material decreases to a certain predetermined point, the insert must be replaced.

In a currently practiced method of replacing the tap hole insert, the retaining piece is unfastened from the bottom of the furnace and is lowered or dropped onto the floor below the furnace. A hollow metal tower or cage is lowered into the furnace. The metal tower has an opening at the bottom, which is slightly larger than the outside diameter of the tap hole insert. The tower is lowered into the furnace until the bottom hole of the tower is adjacent the top of the tap hole insert. A worker climbs into the tower and descends with a hand-held jackhammer to the bottom of the tower. The worker then uses the jackhammer to knock out and chip away the old tap hole insert and associated bonding material. After the tap hole insert is chipped away, a cable is dropped by a crane through the top of the tower and is guided by the worker inside the tower through the well block channel and out of the bottom of the furnace. The cable has an engagement element, such as a metal bar, located at the end of the cable. This engagement element and cable are threaded through a group of replacement insert pieces located on the floor under the furnace. The crane then retracts the cable, pulling the insert pieces into the well block channel to replace the old tap hole insert. The retaining piece is reattached to the bottom of the furnace and dry vibe bonding material is poured into the top of the furnace. The bonding material flows into the gap between the outside of the tap hole insert and the inside of the well block channel to help retain and seal the tap hole insert in place until the insert must again be replaced. The tower and cable are withdrawn from the furnace.

There are drawbacks associated with this conventional method of replacing the tap hole insert. For example, this conventional method requires a worker to enter a tower temporarily positioned inside of the hot furnace. This poses a safety risk for the worker involved. Additionally, this conventional method is very time-consuming and detrimentally impacts upon the productivity time for the furnace. Therefore, it would be advantageous to provide a method and apparatus for installing or replacing a tap hole insert which reduces or eliminates at least some of the drawbacks of the currently practiced method.

SUMMARY OF THE INVENTION

The objects of the present invention are achieved with the apparatus for replacing a tap hole insert in a furnace according to the present invention. The apparatus of the present invention includes a drill detachably mounted to a drive shaft in a boom arm of a utility machine with the drill adapted to remove the existing tap hole inserts to be replaced from outside of the furnace interior, and a tap hole insert tool detachably mounted to the boom arm of the utility machine with the tap hole insert tool adapted to hold and insert tap hole inserts into the furnace tap hole from outside the furnace interior. The invention may include a conventional moving utility machine and an insert tool stand for supporting the tap hole inserts prior to positioning of the tap hole inserts onto the tap hole insert tool. In particular, the insert tool stand may include a base platform and a pair of adjustable side stanchions.

The drill may be a self-centering drill that includes a centering pilot cap at a forward end of the drill, the pilot cap formed as a cylindrical member substantially equal in diameter to the interior diameter of the existing tap hole inserts of the furnace whereby the pilot cap centers the drill during removal of existing tap hole inserts from the furnace. The drill may include a cylindrical base with a plurality of cutting teeth positioned at a forward end of the base, wherein each of the cutting teeth is a rotatable cutting insert positioned in a cutting insert body along a longitudinal axis, such that the positioning of the cutting faces of the inserts and the positioning longitudinal axes of the cutting inserts define a lacing pattern for the drill. The lacing pattern is defined by alternating adjacent inserts between having the longitudinal axis and the cutting faces of individual inserts face radially inwardly of the cylindrical body and having the longitudinal axis and the cutting faces of individual inserts face radially outwardly of the cylindrical body. The drill may include a socket at a rear end of the base that is adapted to be releasably attached to a drive shaft of the utility machine.

The tap hole insert tool may include a shaft receiving the tap hole inserts thereon, a first retention member at a first end of the shaft for preventing the tap hole inserts from moving along the shaft in a first direction beyond the first retention member and a second retention member removably positioned on the shaft for preventing the tap hole inserts from moving along the shaft in a second direction beyond the second retention member. The first retention member may be formed as a stepped flange and the second retention member may be formed as a removable pin.

The method of replacing tap hole inserts from a furnace according to the present invention includes the steps of: attaching a drill to a utility machine; drilling the existing tap hole inserts to be replaced from outside of the furnace interior with the drill to remove the existing tap hole inserts; removing the drill from the utility machine; attaching a tap hole insert tool to the utility machine; positioning the replacement tap hole inserts onto the tap hole insert tool; inserting the tap hole insert tool and the tap hole inserts into the furnace tap hole from outside the furnace interior; bonding the tap hole inserts to the tap hole; and removing the tap hole insert tool from the tap hole.

These and other advantages of the present invention will be clarified in the description of the preferred embodiments taken together with the attached figures wherein like reference numeral represent like elements throughout.

BRIEF DESCRIPTION OF THE DRAWINGS

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
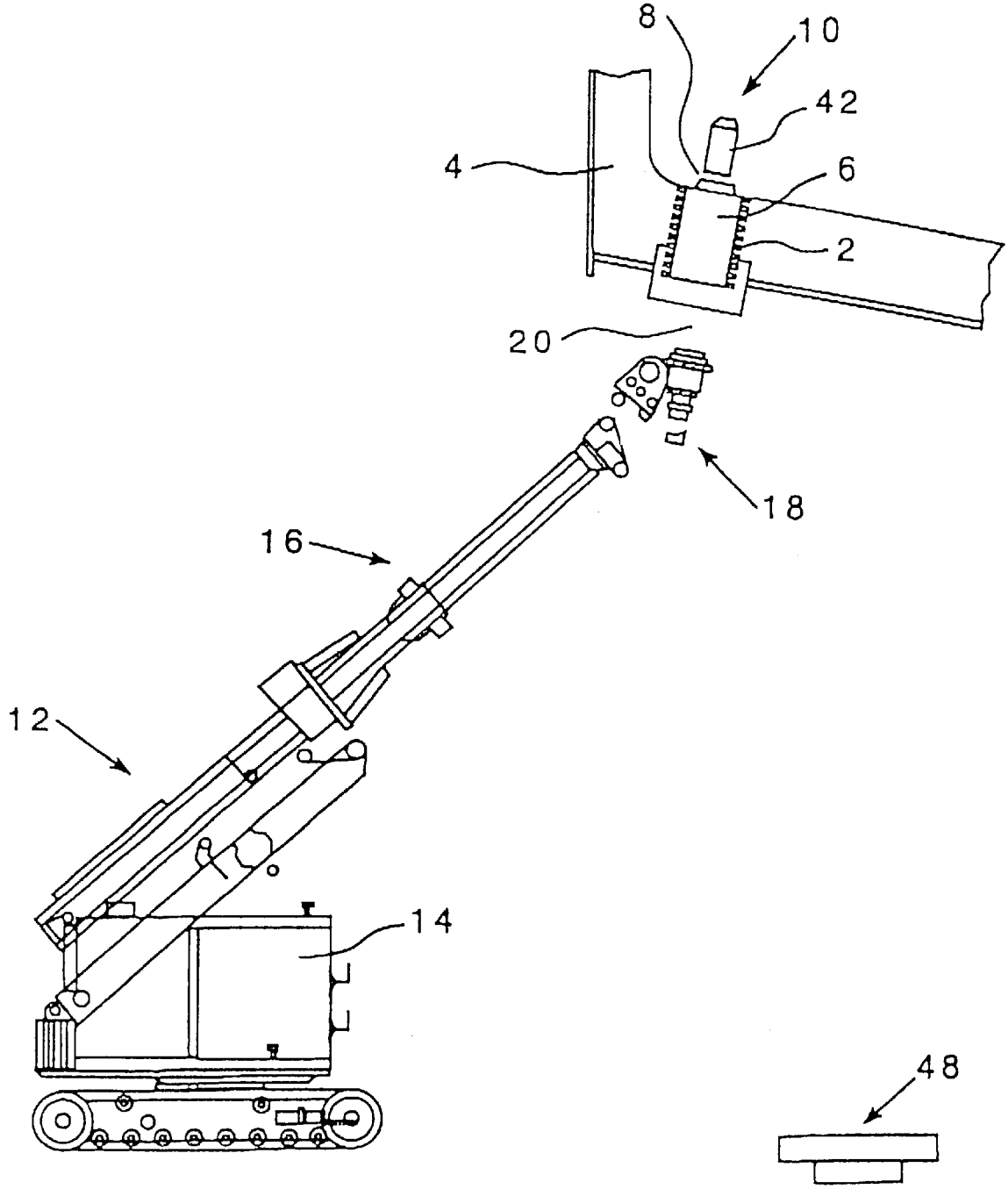
FIG. 1 is a side, schematic view showing the removal of a worn tap hole insert in accordance with the invention.

For purposes of the description hereinafter, the terms "above", "below", "right", "left", "top", "bottom" and similar directional terms shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting to the invention.

FIG. 1 depicts the removal of a worn tap hole insert in accordance with the invention. As shown in FIG. 1, a well block 2 of refractory material is located at the bottom of a furnace 4. The well block 2 has a well block channel 6 into which a tap hole insert 8, formed from a plurality of stacked, annularly-shaped insert pieces, is located. With time, the flow of molten metal through the central passage of the insert 8 burns away the insert material. When the lateral thickness of the insert material between the flow passage and the side of the well block channel 6 has been reduced to a certain predetermined amount, the tap hole insert 8 must be replaced. In the practice of the invention, a coredrill 10 is used to remove the worn tap hole insert 8. As shown in FIG. 1, the coredrill 10 is attached to a conventional utility machine 12, such as a Grant-O-Matic machine, preferably a Grant-O-Matic Model 360 BDR or 360 BDRE machine manufactured by Louis A. Grant, Inc. of Export, Pa. The machine 12 includes a tracked carriage 14 having an extensible arm 16 to which is movably mounted a drive assembly 18 having a drive shaft 20. The Grant-O-Matic machine is commercially available and will not be described in great detail since its structure and operation are well understood by one of ordinary skill in the art. Although in the preferred embodiments of the invention described herein a Grant-O-Matic machine is preferred, it is to be understood that the invention is not limited to use with this particular machine but could be adapted for use with other conventional such machines.

Figure 2A:
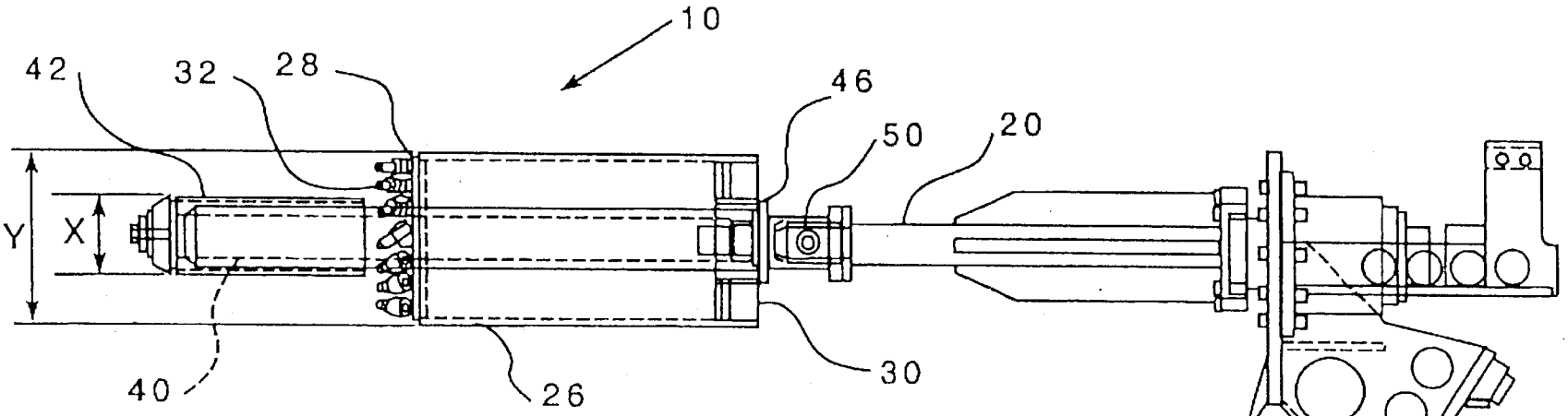
FIG. 2A is a side view of a coredrill of the invention attached to the drive shaft of a conventional machine.
Figure 2B:
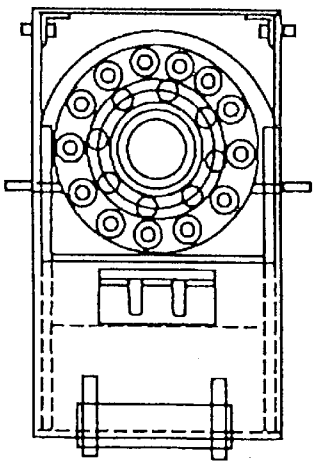
FIG. 2B is a front view of the coredrill of FIG. 2A.
Figure 3A:
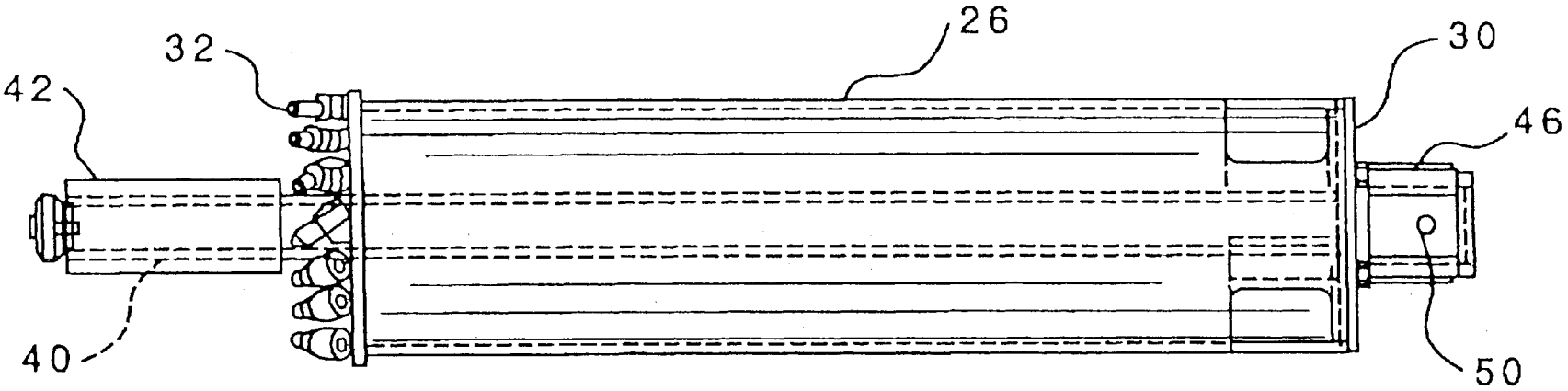
FIG. 3A is a side view of the coredrill of FIG. 2A detached from the drive shaft.
Figure 3B:
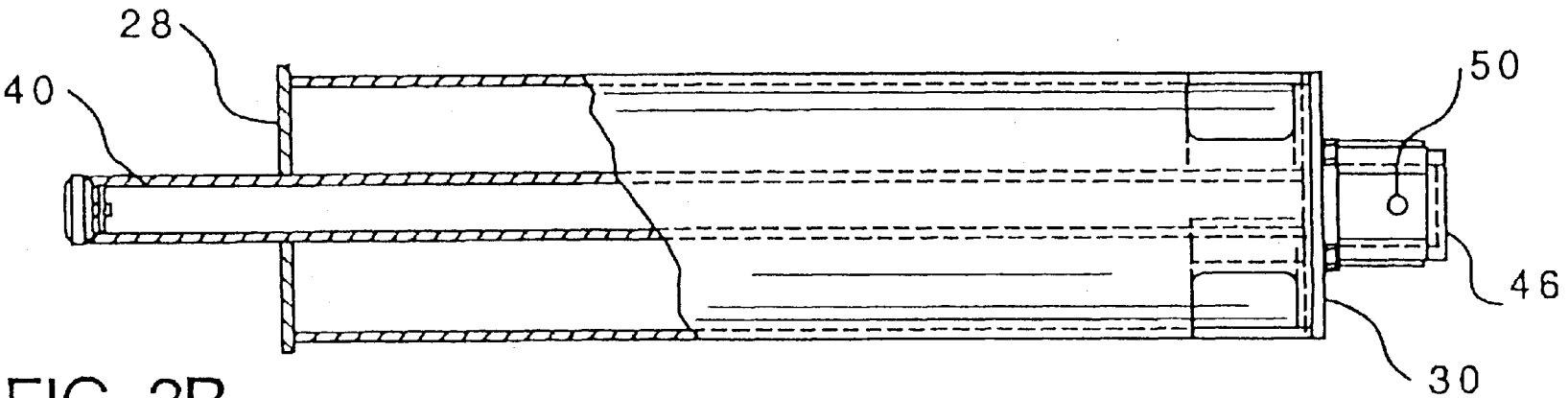
FIG. 3B is a side view of the coredrill of FIG. 3A with a pilot cap removed.
Figure 4:
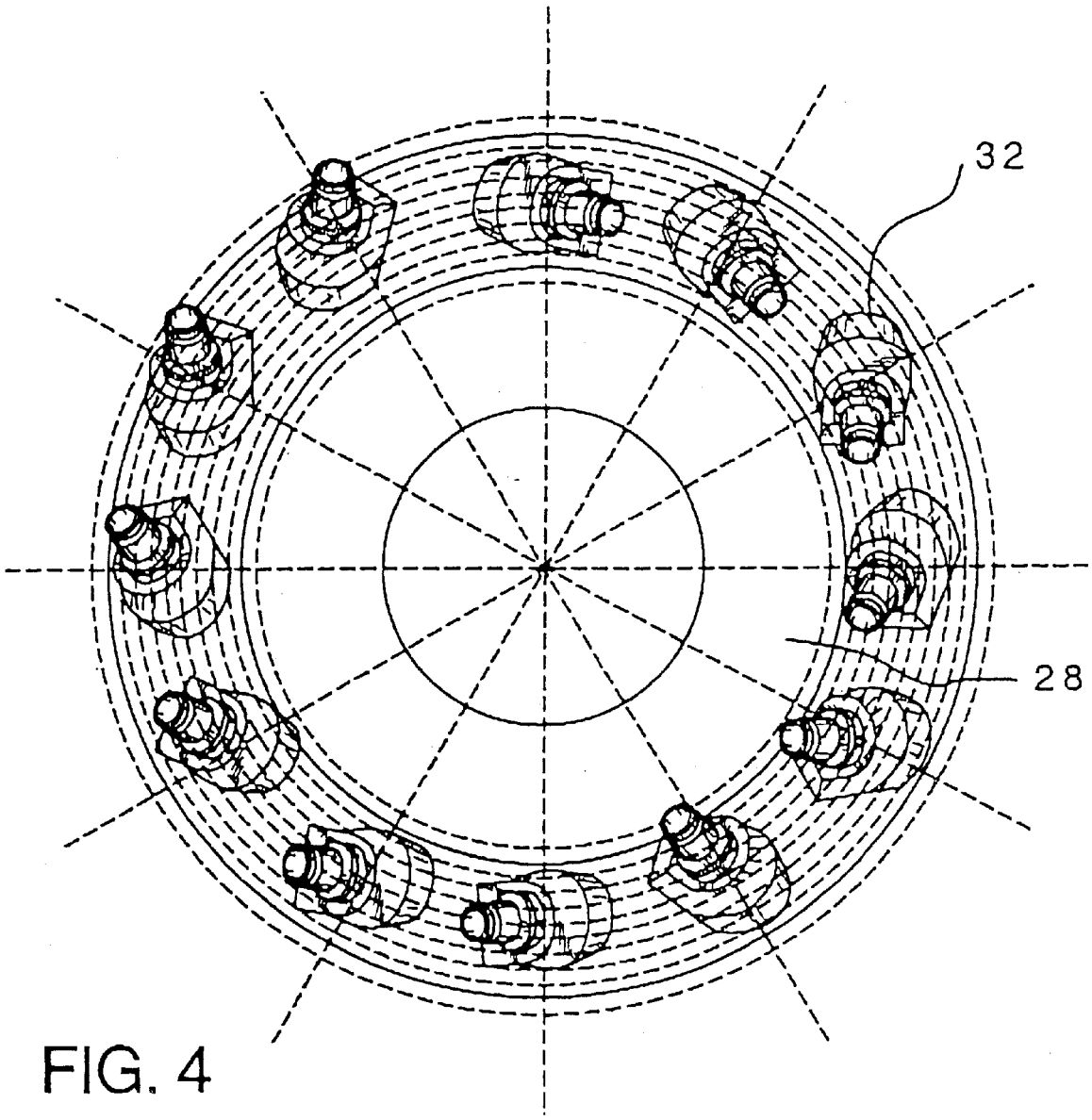
FIG. 4 is an end view of the coredrill of FIG. 3A showing a lacing pattern of coredrill cutting teeth.
Figure 5:
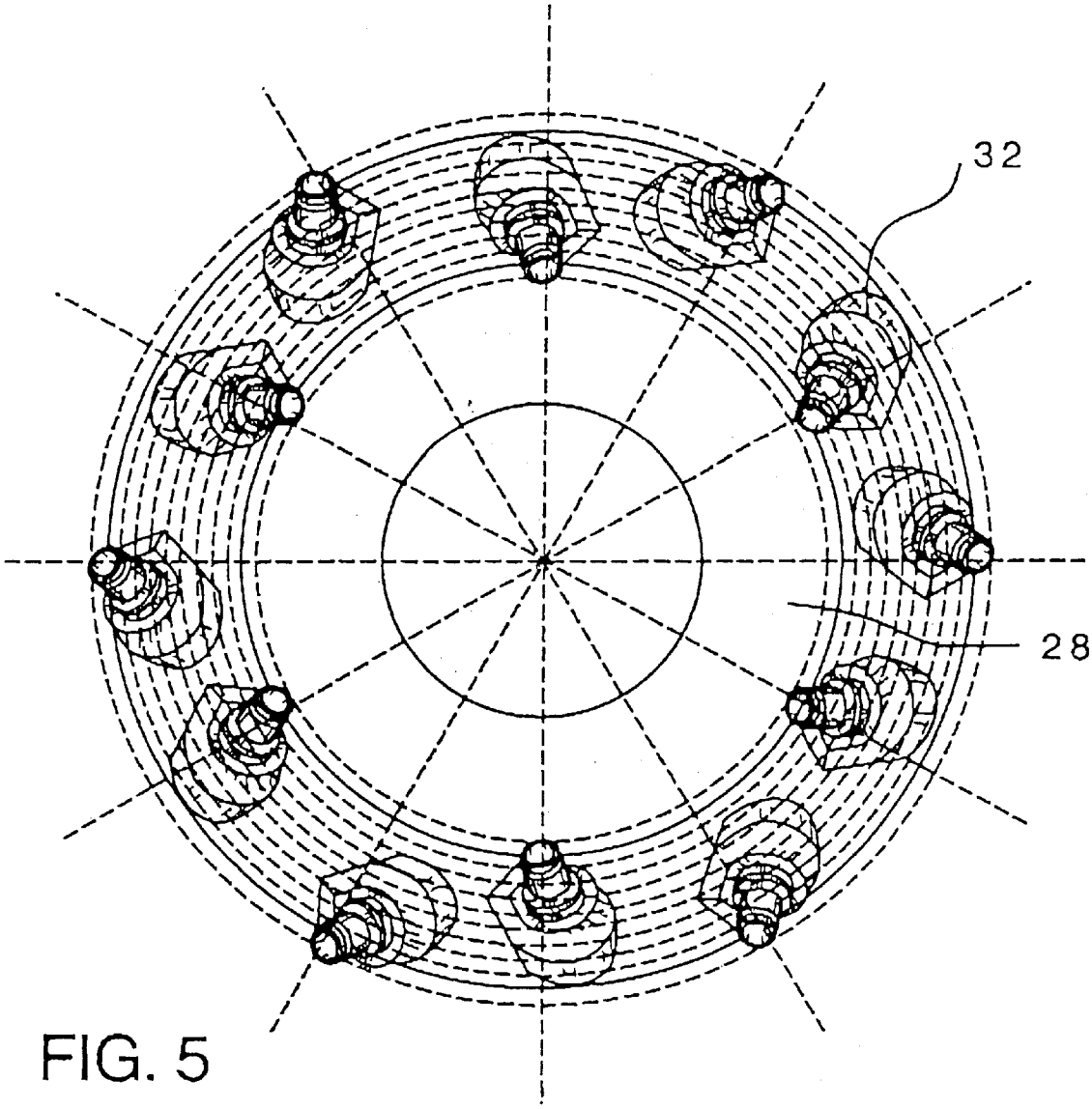
FIG. 5 is an end view of an alternative embodiment of the coredrill showing an alternative lacing pattern for the cutting teeth.

FIG. 2A shows the coredrill 10 of the invention attached to the drive shaft 20 of the machine 12. As shown in FIGS. 2A–3B, the coredrill 10 includes a substantially cylindrical, metal base member 26 having a front end 28 and a rear end 30. A plurality of axially spaced tungsten carbide cutting teeth 32 are removably mounted on the front end 28 of the base member 26. For example, the teeth 32 may be held in place with a conventional compression retaining ring that fits into a groove on the front end 28 of the base member 26. The teeth 32 are annularly arranged in a lacing pattern on the front end 28 of the base member 26. One example of a lacing pattern of the invention is shown in FIG. 4. An alternative lacing pattern is shown in FIG. 5.

As shown in FIGS. 2A–3B, a pilot shaft 40 extends from the front end 28 of the base member 26 and a pilot cap 42 is removably attached to the outer end of the pilot shaft 40 in conventional manner, such as by a bolt or screw. A socket device 46 configured to engage the drive shaft 20 of the machine 12 is located on the rear end 30 of the base member 26. For example, the coredrill 10 can be held in place on the drive shaft 20 by a conventional retaining pin assembly which engages a bore 50 located in the socket device 46. As will be explained in more detail hereinafter, the cap 42 has an outside diameter X, which is substantially equivalent to the inside diameter of the central passage in the tap hole insert 8. The base member 26 has an outside diameter Y which is substantially equivalent to the inside diameter of the well block channel 6 in which the tap hole insert 8 is located. Preferably, the outside diameter Y of the base member 26 is about ⅜" less than the inside diameter of the well block channel 6.

As shown in FIG. 1, when a worn insert is to be replaced, the retaining piece 48 is removed from the furnace 4. The coredrill 10 is positioned by the machine 12 near the bottom (outlet) of the tap hole insert 8 and the cap 42 is inserted into the tap hole insert passage. The cap 42 on the end of the pilot shaft 40 serves as a guide to guide the cutting teeth 32 on the base member 26. The coredrill 10 is rotated by the drive shaft 20 and the coredrill 10 is forced upwardly into the insert passage. The cutting teeth 32 on the base member 26 engage the bottom of the tap hole insert 8 and, as the coredrill 10 is moved upwardly, cut out the old tap hole insert 8 and most of the bonding material between the outside of the tap hole insert 8 and the side of the well block channel 6. The coredrill 10 is moved along the longitudinal axis of the well block channel 6 so as to avoid contacting the side of the well block channel 6 with the teeth 32. After the tap hole insert material has been cut out, the coredrill 10 is retracted and disengaged from the drive assembly 18, e.g., by disengaging the retaining pin assembly. Thus, no worker need enter the inside of the furnace to remove the worn tap hole insert 8.

After the coredrill 10 is removed from the drive shaft 20, a tap hole insert tool of the invention is attached to the drive shaft 20 so that a new tap hole insert 8 can be inserted into the well block channel 6. Before discussing the method of inserting the new tap hole insert, the components of the tap hole insert tool of the invention will first be discussed.

Figure 8:
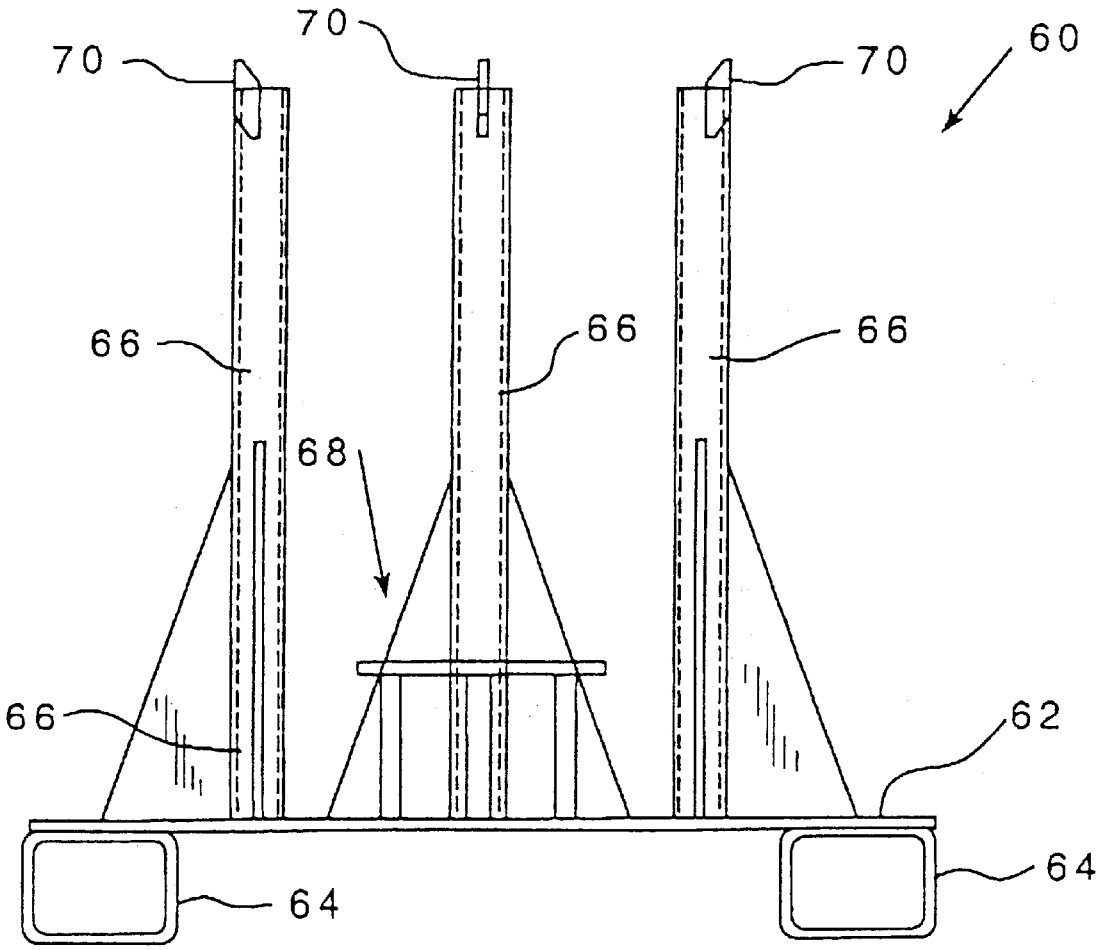
FIG. 8 is a side view of an attachment stand of the invention.

An insert tool stand 60 is shown in FIG. 8. The stand 60 includes a base 62 having a pair of opposed, hollow members 64 attached to the bottom of the base 62 and configured to receive the forks of a forklift truck. A plurality, e.g., three, stanchions 66 extend substantially vertically, e.g., perpendicularly, from the top of the base 62 and surround an elevated platform 68. As will be discussed in more detail hereinbelow, the platform 68 has an opening extending therethrough. Positioning elements 70, such as metal pieces, are mounted on the top of each stanchion 66.

An insert tool 74 of the invention is shown in FIGS. 7A–7D. The insert tool 74 includes a head 76 having an attachment member 78, such as a bore 80, configured to engage the drive shaft 20 of the drive assembly 18. A hole 82 is located in the head 76 to attach the insert tool 74 to the drive shaft 20, such as by a conventional locking pin device. A substantially circular, metal flange assembly 84 is located adjacent the head 76. The flange assembly 84 may include one or more annular flange members 86 of differing outside diameters to form a step on the flange assembly 84. A hollow, metal alignment shaft 88 extends from the head 76 and has an attachment hole 90 located near the outer end of the shaft 88 to receive a retaining pin, as discussed hereinbelow. The outside diameter of the shaft is configured to substantially correspond to the inside diameter of the tap hole insert pieces. The length of the shaft is configured based on the number of tap hole insert pieces, which need to be inserted into the tap hole insert channel.

Figure 6:
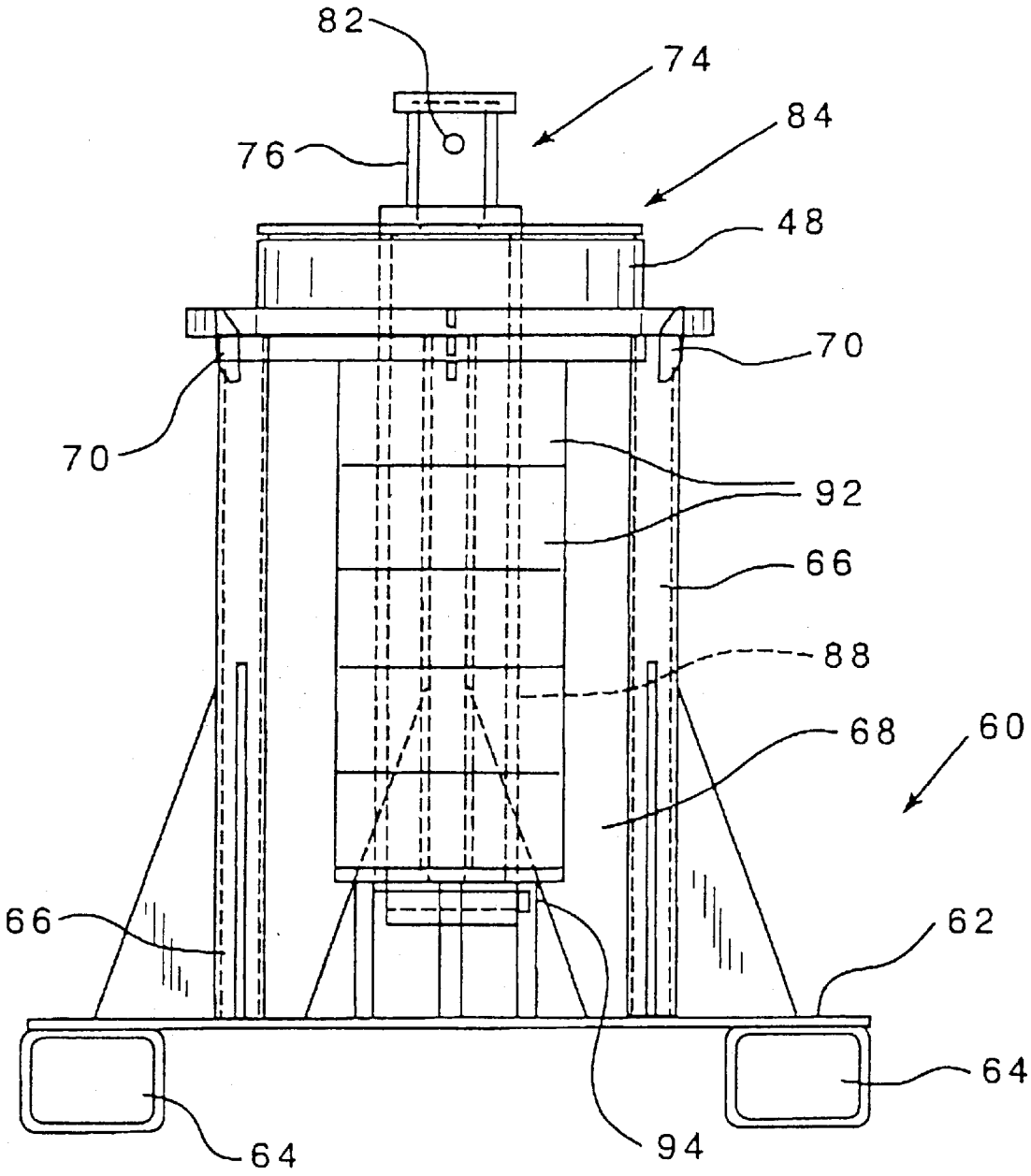
FIG. 6 is a side, schematic view of an assembled tap hole insert assembly.
Figure 7D:
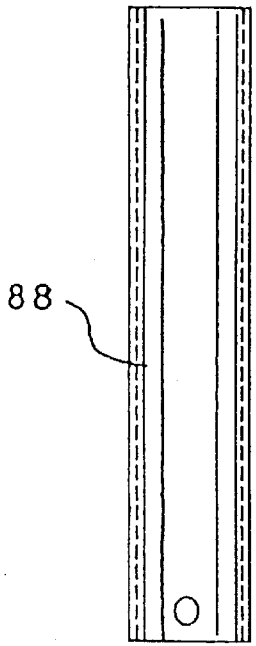
FIG. 7D is a side view of an alignment shaft of the insert tool.
Figure 7C:
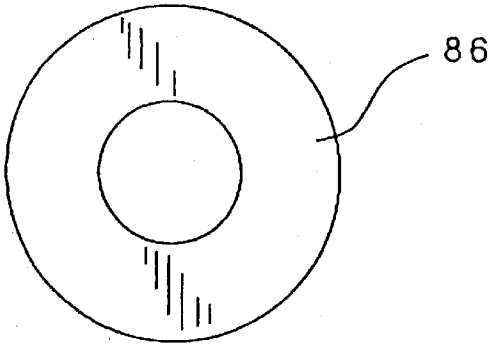
FIG. 7C is a plan view of a second flange member of the insert tool of the invention.
Figure 7B:
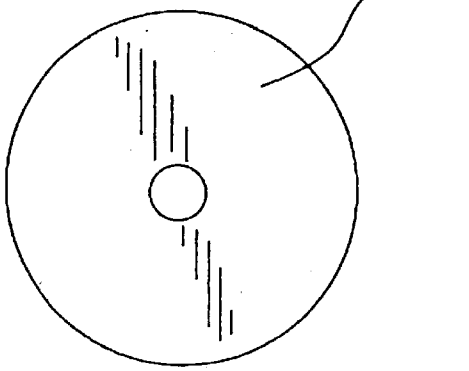
FIG. 7B is a plan view of a first flange member of the insert tool of FIG. 7A.
Figure 7A:
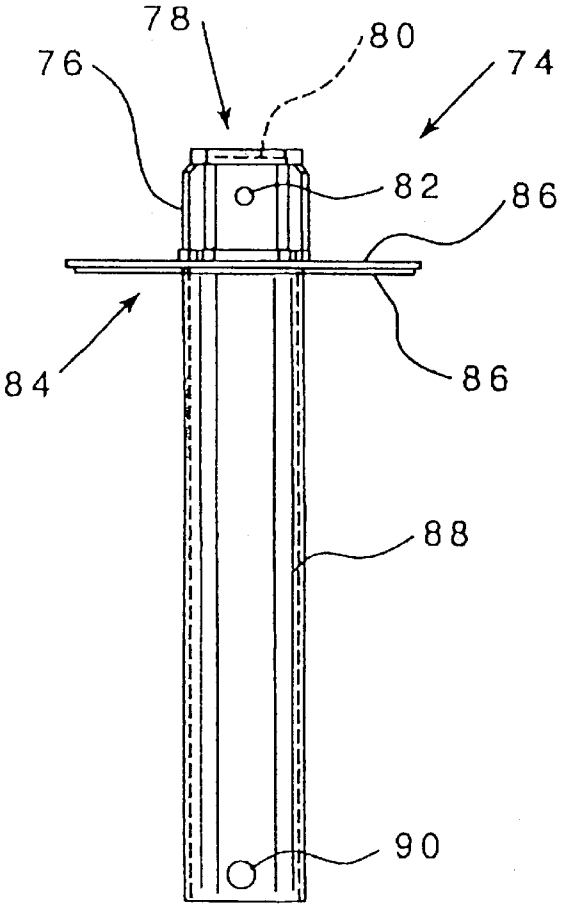
FIG. 7A is a side view of a tap hole insert tool of the invention.

As shown in FIG. 6, a plurality of tap hole insert pieces 92 are stacked onto the platform 68 of the stand 60. The number of insert pieces 92 depends on the length of the tap hole insert required for a particular furnace. The retaining piece 48 for the furnace is placed on top of the stanchions 66 and is prevented from moving sideways by the positioning elements 70. In this position, the central hole in the retaining piece 48 is aligned with the holes in the insert pieces 92. In order to accommodate different furnace types, the length of the stanchions 66 may be adjustable in conventional manner, such as by forming the stanchions 66 of two or more telescoping metal pieces which can be held at a desired position by a locking pin. In this manner, different heights of stacked insert pieces 92 can be formed with the same stand 60 for different furnace requirements. As shown in FIG. 6, the shaft 88 of the insert tool 74 is inserted into the top of the retaining piece 48 and the tool 74 is lowered until the flange assembly 84 abuts the retaining piece 48. In this position, the end of the shaft 88 extends through the hole in the platform 68 and a retaining pin 94 may be inserted through the attachment hole 90 in the shaft 88 to couple the stacked insert pieces 92 and the retaining piece 48 with the tool 74. This assembly of the insert pieces 92, retaining piece 48 and tool 74 is preferably conducted at a location remote from the furnace so as not to interfere with normal furnace operation. This assembly can occur well before the tap hole insert of the furnace needs to be replaced and the assembled components simply held in inventory until needed.

Figure 9:
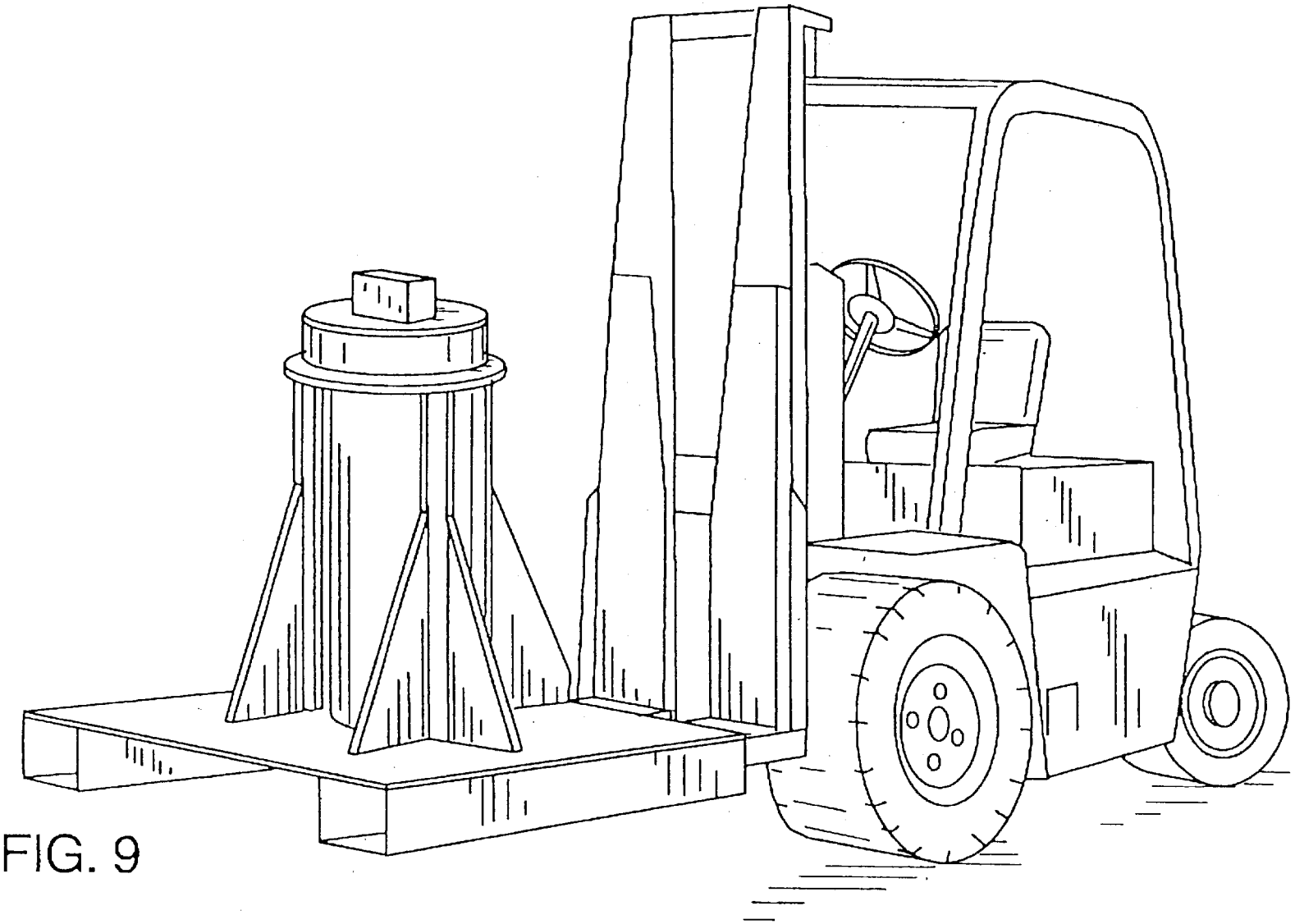
FIGS. 9–13 show the transport and attachment procedure for inserting a tap hole insert into a furnace, incorporating features of the invention.
Figure 10:
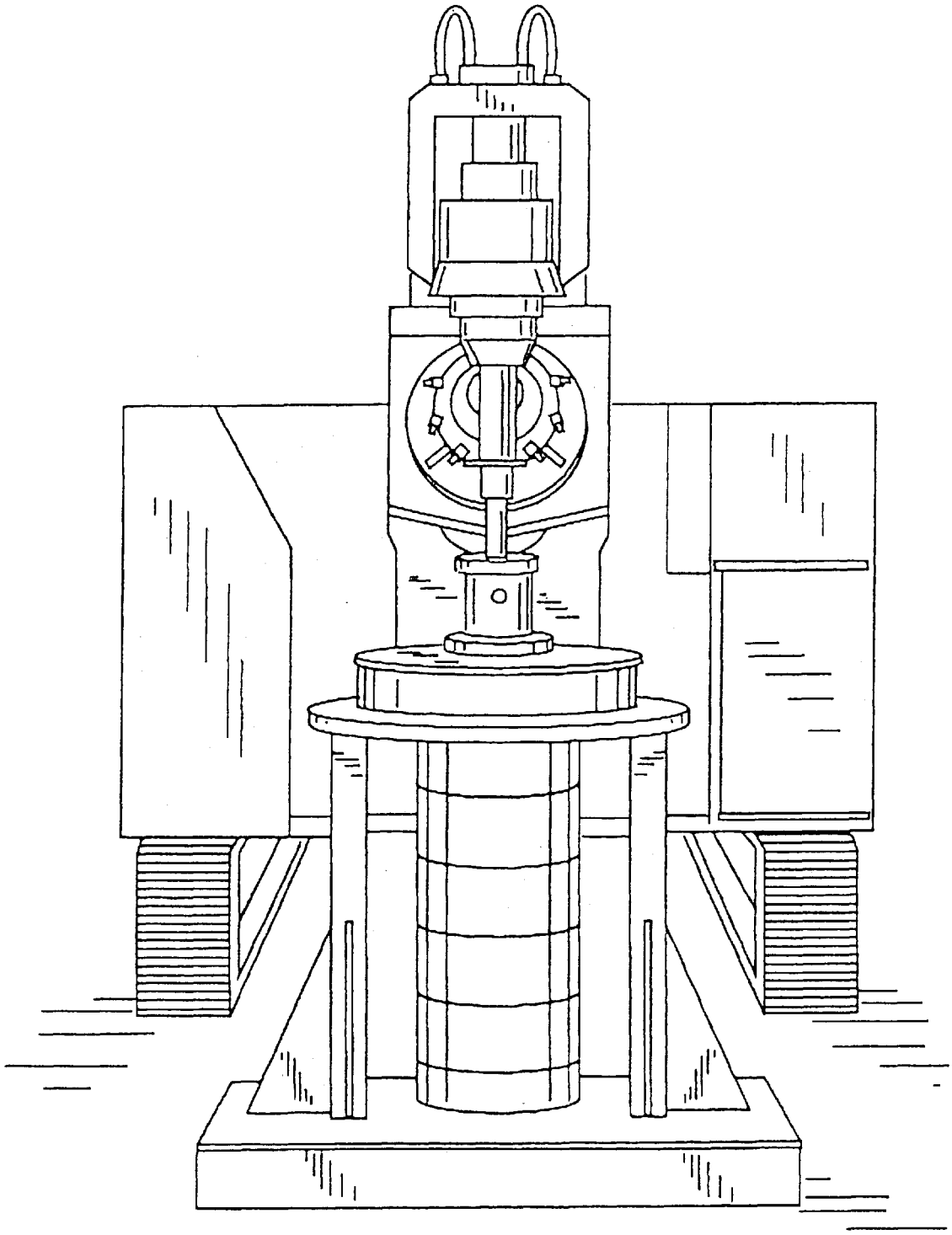
Figure 11:
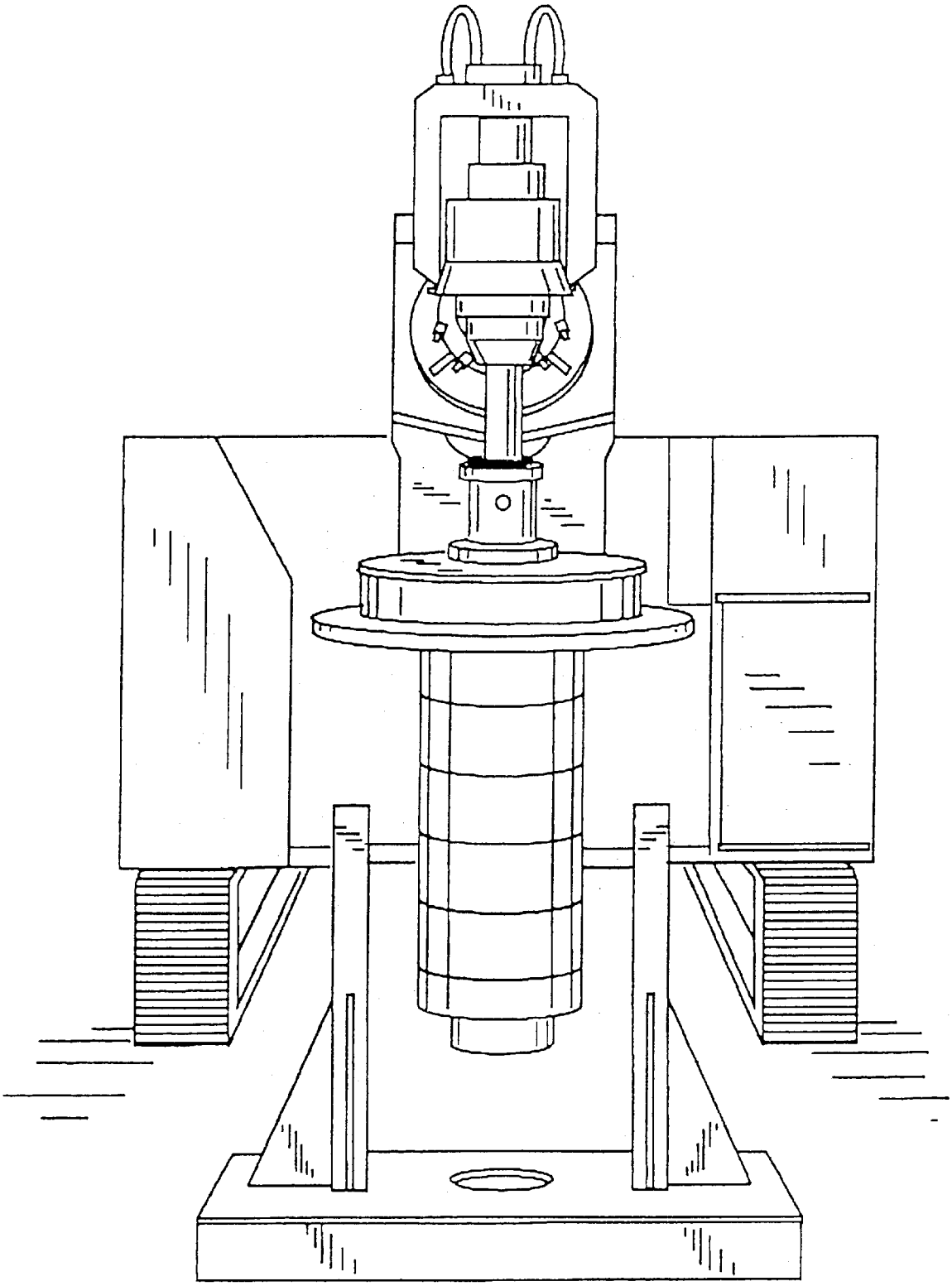

When needed, the stand 60 with the insert assembly can then be transferred to the furnace area, such as by forklift as shown in FIG. 9. At the furnace, the worn tap hole insert 8 is removed by the coredrill 10 as described above. When the coredrill 10 is detached from the drive shaft 20, the drive shaft 20 of the drive assembly 18 is inserted into the head 76 of the tool 74 and locked in place, such as by an attachment pin passing through the hole 82, as shown in FIG. 10. The machine arm 16 is then used to lift the tool 74 and associated insert pieces 92 and retaining piece 48 off of the stand 60, as shown in FIG. 11. The retaining pin 94 prevents the insert pieces 92 from sliding off of the shaft 88.

Figure 12:
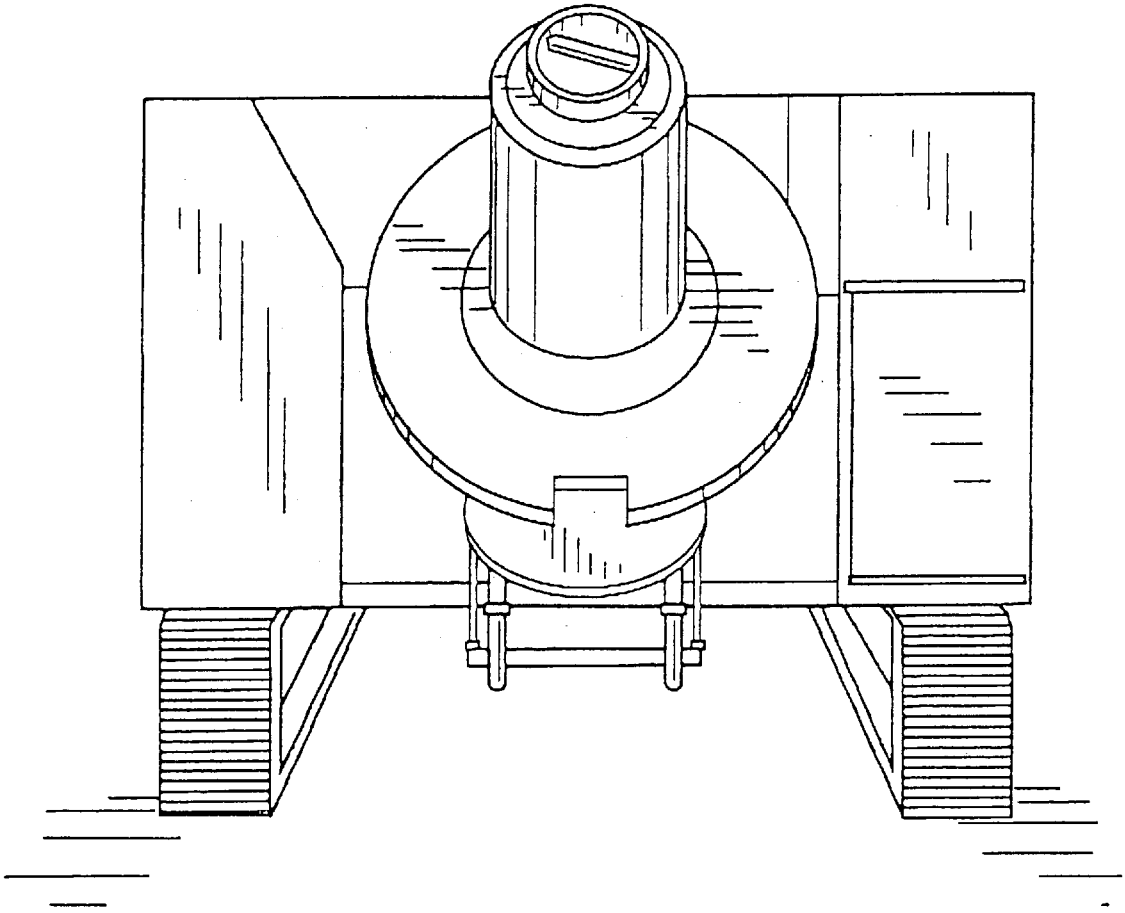
Figure 13:
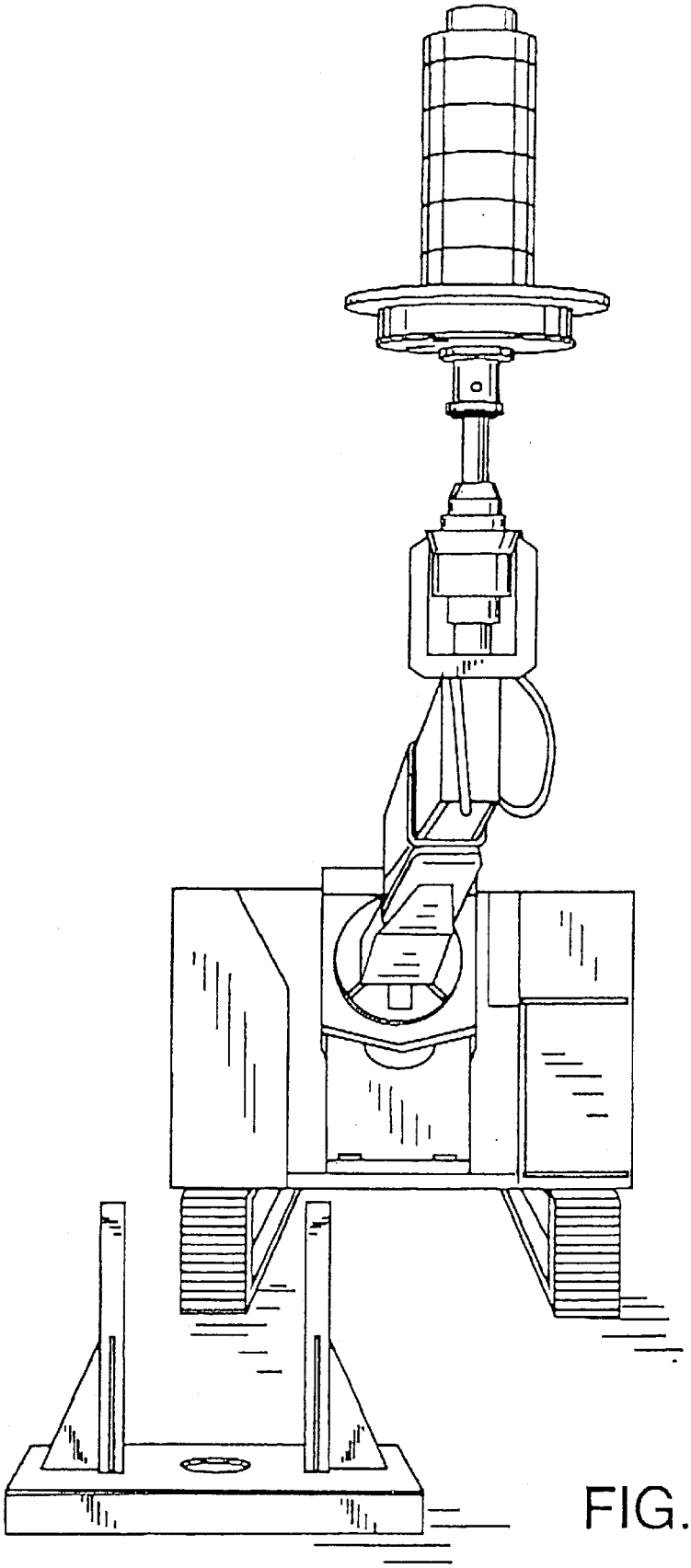

Next, the tool 74 is inverted, as shown in FIG. 12, with the insert pieces 92 uppermost and resting on the flange assembly 84. The retaining pin 94 is then withdrawn from the shaft 88. Thus, in this position, the insert pieces 92 are held simply by gravity on the flange assembly 84. As shown in FIG. 13, the tool 74 is elevated to align the stacked insert pieces 92 with the well block channel 6 and the new tap hole insert is then inserted into the well block channel 6. When the retaining piece 48 is near the bottom of the furnace, the drive assembly 18 can be used to rotate the retaining piece 48 to align the attachment elements on the retaining piece 48, such as slots or holes, with the attachment elements on the furnace, such as lugs or other conventional devices. The retaining piece 48 is then attached to the bottom of the furnace in conventional manner. With the new tap hole insert in place, bonding material, such as dry vibe, is poured into the top of the furnace to flow between the outside of the insert and the well block channel sidewall in conventional manner. The insert tool 74 is retracted from the installed insert pieces 92 and disengaged from the drive shaft 20 of the machine 12 for use with assembling another insert assembly.

In general, the method of replacing the tap hole insert operates as follows:

- E.B. Electric furnace is prepared and ready for tap hole insert replacement.
- Gom-360bdre or Gom-360bdr with coredrill traverses under furnace.
- Tap hole slide gate and retainer are removed.
- Gom-360bdre or Gom-360bdr drills out the spent tap hole insert taking 1 to 5 minutes.
- Tap hole coredrill is placed in transport stand and removed from drive assembly by extracting retainer pin.
- The machine rotates and places the coredrill drive shaft into the tap hole insert tool.
- The tap hole tool with inserts attached are removed from the transport stand.

Rotate the boom 180° and tool up. Now the insert toll is in a horizontal position and the inert retainer pin can be removed.

Using the machine boom functions insert the tap hole insert assembly into the tap hole block.

Using the coredrill drive rotate the insert assembly to align the insert retainer with the mounting lugs.

Install refectory dry-vibe around tap hole inserts. Then remove tap hole insertion tool. Completing the installation procedure.

It will be readily appreciated by those skilled in the art that modifications may be made to the invention without departing from the concepts disclosed in the foregoing description. Accordingly, the particular embodiments described in detail hereinabove are illustrative only and are not limiting to the scope of the invention which is to be given the full breadth of the above disclosure and any and all equivalents thereof.

What is claimed is:

1. A self-centering drill detachably mounted to a utility machine, the drill adapted to remove an existing tap hole insert with an interior diameter, wherein the tap hole insert is to be replaced from outside of a furnace interior, the drill comprising a cylindrical base with a plurality of cutting teeth positioned at a forward end of the base, wherein each of the cutting teeth is a rotatable cutting insert positioned in a cutting insert body along a longitudinal axis, wherein the positioning of the cutting faces of the inserts and the positioning longitudinal axes of the cutting inserts define a lacing pattern for the drill and wherein the lacing pattern is defined by alternating adjacent inserts having the longitudinal axis and the cutting faces of individual inserts face radially inwardly of the cylindrical body and having the longitudinal axis and the cutting faces of individual inserts face radially outwardly of the cylindrical body and wherein the drill further includes a centering pilot cap at a forward end of the drill, whereby the pilot cap centers the drill during removal of a tap insert from the furnace.

2. The drill of claim 1, wherein the pilot cap is a cylindrical member substantially equal in diameter to the interior diameter of the existing tap hole insert of the furnace.

3. An apparatus for replacing a tap hole insert in a furnace having a furnace interior and a furnace tap hole, the apparatus comprising:

a drill detachably mounted to a utility machine, the drill adapted to remove the existing tap hole insert to be replaced from outside of the furnace interior; and a tap hole insert tool detachably mounted to the utility machine, the tap hole insert tool adapted to hold and insert a plurality of stacked, annular tap hole inserts into the furnace tap hole from outside the furnace interior, wherein the tap hole insert tool includes at least one retention member, removably positioned on the tap hole insert tool for preventing the plurality of stacked annular tap inserts from moving along the tap hole insert tool beyond the at least one retention member while the at least one removable retention member is attached to the tap hole insert tool.

4. The apparatus of claim 3, wherein the drill includes a centering pilot cap at a forward end of the drill, the pilot cap formed as a cylindrical member substantially equal in diameter to the interior diameter of the existing tap hole insert of the furnace wherein the pilot cap centers the drill during removal of an existing tap hole insert from the furnace.

5. The apparatus of claim 3, wherein the drill includes a cylindrical base with a plurality of cutting teeth positioned at a forward end of the base.

6. The apparatus of claim 3, wherein each of the cutting teeth is a rotatable cutting insert positioned in a cutting insert body along a longitudinal axis, wherein the positioning of the cutting faces of the inserts and the positioning longitudinal axes of the cutting inserts define a lacing pattern for the drill.

7. The apparatus of claim 6, wherein the lacing pattern is defined by a set of inserts extending at least one-half of the circumference of the base, wherein the longitudinal axis of the inserts of the set is progressively offset from adjacent inserts in one direction.

8. The apparatus of claim 6, wherein the lacing pattern is defined by alternating adjacent inserts between having the longitudinal axis and the cutting faces of individual inserts face radially inwardly of the cylindrical body and having the longitudinal axis and the cutting faces of individual inserts face radially outwardly of the cylindrical body.

9. The apparatus of claim 3, wherein the drill includes a socket at a rear end of the base, the socket adapted to be releasably attached to a drive shaft of the utility machine.

10. The apparatus of claim 3, wherein the tap hole insert tool includes a shaft receiving the plurality of stacked, annular tap hole inserts thereon, a first retention member at a first end of the shaft for preventing the plurality of stacked, annular tap hole inserts from moving along the shaft in a first direction beyond the first retention member and a second retention member removably positioned on the shaft for preventing the plurality of stacked, annular tap hole inserts from moving along the shaft in a second direction beyond the second retention member.

11. The apparatus of claim 10, wherein the first retention member is a stepped flange.

12. The apparatus of claim 10, wherein the second retention member is a removable pin.

13. The apparatus of claim 12, further including an insert tool stand for supporting the plurality of stacked, annular tap hole inserts prior to positioning of the tap hole inserts onto the tap hole insert tool.

14. The apparatus of claim 13, wherein the insert tool stand includes a base platform and a pair of adjustable side stanchions.

15. An apparatus for replacing a tap hole insert in a furnace having a furnace interior and a furnace tap hole, the apparatus comprising:

a moving universal machine having a drive shaft within a boom arm;

a self-centering drill detachably mounted to the boom arm of the utility machine, the drill adapted to remove the existing tap hole insert to be replaced from outside of the furnace interior; and a tap hole insert tool detachably mounted to the boom arm of the utility machine, the tap hole insert tool adapted to hold and insert a plurality of stacked, annular tap hole inserts into the furnace tap hole from outside the furnace interior, wherein the tap hole insert tool includes at least one retention member, removably positioned on the tap hole insert tool for preventing the plurality of stacked annular tap inserts from moving along the tap hole insert tool beyond the at least one retention member while the at least one removable retention member is attached to the tap hole insert tool.

16. The apparatus of claim 15, further including an insert tool stand for supporting the stacked, annular tap hole inserts prior to positioning of the plurality of stacked, annular tap hole inserts onto the tap hole insert tool, wherein the insert tool stand includes a base platform and a pair of adjustable side stanchions.

17. The apparatus of claim 15, wherein the tap hole insert tool includes a shaft receiving the plurality of stacked, annular tap hole inserts thereon, a first retention member at a first end of the shaft for preventing the tap hole inserts from moving along the shaft in a first direction beyond the first retention member and a second retention member removably positioned on the shaft for preventing the plurality of stacked, annular tap hole inserts from moving along the shaft in a second direction beyond the second retention member, wherein the first retention member is a flange and the second retention member is a removable pin.

18. The apparatus of claim 15, wherein the drill includes a socket at a rear end of the drill, the socket adapted to be releasably attached to the drive shaft of the utility machine, and wherein the end of the tap hole insert tool includes a socket adapted to be releasably attached to the drive shaft of the utility machine.

19. A tap hole insert tool adapted to be detachably mounted to a boom arm of a utility machine, the tap hole insert tool adapted to hold and insert a plurality of stacked, annular tap hole inserts into a furnace tap hole from outside the furnace interior, the tap hole insert tool including a shaft receiving each of the plurality of stacked, annular tap hole inserts thereon, a first retention member at a first end of the shaft for preventing the plurality of stacked, annular tap hole inserts from moving along the shaft in a first direction beyond the first retention member and a second retention member removably positioned on the shaft for preventing the plurality of stacked, annular tap hole inserts from moving along the shaft in a second direction beyond the second retention member, wherein the first retention member is a flange and the second retention member is a removable pin.

20. The tap hole insert of claim 19, wherein the end of the tap hole insert tool includes a socket adapted to be releasably attached to the drive shaft of the utility machine.

21. The tap hole insert tool of claim 19, wherein the flange is a stepped flange.

22. A method of replacing a tap hole insert from a furnace having a furnace interior and a furnace tap hole comprising the steps of:

attaching a drill to a utility machine;

drilling an existing tap hole insert to be replaced from outside of the furnace interior with the drill to remove the existing tap hole insert;

removing the drill from the utility machine;

attaching a tap hole insert tool to the utility machine;

positioning a plurality of stacked, annular replacement tap hole inserts onto the tap hole insert tool;

inserting the tap hole insert tool and the plurality of stacked, annular tap hole inserts into the furnace tap hole from outside the furnace interior; and bonding the plurality of stacked, annular tap hole inserts to the tap hole; and removing the tap hole insert tool from the tap hole.

* * * * *